US005158449A

United States Patent [19]

Bryan et al.

[11] Patent Number: 5,158,449

[45] Date of Patent: Oct. 27, 1992

[54] THERMAL ASH AGGLOMERATION PROCESS

[75] Inventors: Bruce G. Bryan, Wilmette; Mark J. Khinkis, Morton Grove; Amirali G. Rehmat, Westmont, all of Ill.

[73] Assignee: Institute of Gas Technology, Chicago, Ill.

[21] Appl. No.: 763,903

[22] Filed: Sep. 23, 1991

Related U.S. Application Data

[63] Continuation-in-part of Ser. No. 638,797, Jan. 8, 1991, abandoned.

[51] Int. Cl.[5] ..... F27B 15/00; F22B 1/00

[52] U.S. Cl. ..... 432/15; 432/58; 110/245; 110/345; 110/346; 110/347; 122/4 D

[58] Field of Search ..... 110/245, 342, 346, 347; 432/15, 58; 122/4 D

[56] References Cited

U.S. PATENT DOCUMENTS 3,397,657 8/1968 Tada .
3,914,089 10/1975 Desty et al. .
4,017,253 4/1977 Wielang et al. .
4,021,184 5/1977 Priestley .
4,229,289 10/1980 Victor .
4,262,611 4/1981 Kuhnert et al. .
4,308,806 1/1982 Uemura et al. .
4,315,758 2/1982 Patel et al. .
4,543,894 10/1985 Griswold et al. ..... 122/4 D
4,693,682 9/1987 Lee et al. .
4,815,418 3/1989 Maeda et al. .
4,831,944 5/1989 Durand et al. .
4,854,249 8/1989 Khinkis et al. .
4,955,942 9/1990 Hemenway, Jr. .

*Primary Examiner*—Henry C. Yuen
*Attorney, Agent, or Firm*—Speckman & Pauley

[57] ABSTRACT

A process and apparatus for thermal agglomeration of high melting temperature ashes in fluidized bed processes is disclosed. Carbonaceous material to be combusted, incinerated or gasified is introduced into a fluidized bed supported on a perforated sloping supported grid through which a fluidizing gas is injected. An upflowing discharge control gas is injected through a density/size solids withdrawal conduit in communication with the base of the perforated sloping support grid. Positioned within the solids withdrawal conduit is a central jet pipe through which fuel and oxidant are injected into the base of the fluidized bed forming a hot temperature zone in which ash melts and agglomerates. Positioned above the perforated sloping support grid and peripherally mounted through the reactor wall are one or more burners through which fuel and oxidant are injected into the fluidized bed forming supplemental hot temperature zones in which ash melts and agglomerates. The temperature of the supplemental hot zones is controlled independent of the bulk-bed temperature of the fluidized bed by the amount of fuel injected through the burners and can be maintained substantially higher than the bulk-bed temperature, thereby enabling the agglomeration of higher melting temperature ashes.

13 Claims, 4 Drawing Sheets

THERMAL ASH AGGLOMERATION PROCESS

CROSS REFERENCE TO RELATED APPLICATION

This application is a continuation-in-part of copending U.S. patent application Ser. No. 07/638,797 filed Jan. 8, 1991, now abandoned.

BACKGROUND OF THE INVENTION

1. Field of the Invention

This invention relates to a process and apparatus for agglomerating high melting temperature ashes produced in a wide variety of fluidized bed processes including combustion and gasification of coal, other fossil or biomass fuels and waste materials. More specifically, this invention relates to the creation of a plurality of high temperature zones within a fluidized bed in a fluidized bed process to melt ashes produced in the process having a melting temperature above about 2000° F., forming sticky ash particles which adhere to each other to form ash agglomerates. These ash agglomerates can then be withdrawn using density/size selective solids withdrawal.

2. Description of the Prior Art

A significant problem in the operation of high temperature fluidized bed processes such as fluidized bed gasification of coal, fossil or biomass fuels and waste materials is the fusion of ash particles to form large agglomerates in the fluidized bed causing occlusion of the reactor unless they are removed. At least one solution to this problem is disclosed by U.S. Pat. No. 4,315,758 which teaches an inverted conical withdrawal section (hereinafter referred to as a perforated sloping support grid) positioned in the bottom of the fluidized bed reactor having a central opening in communication with a venturi-type nozzle through which is injected a high velocity air/steam stream. In the center of the nozzle is positioned a central jet pipe which extends above the constricted center section and through which an oxygen-containing gas is injected into the fluidized bed. According to the teachings of this patent, the tendency for ash to sinter and occlude in the nozzle and central opening of the perforated sloping support grid is controlled, if not eliminated, by passing the oxygen containing gas into the nozzle through the central jet pipe. U.S. Pat. No. 4,854,249 discloses a two stage combustion process, the first stage of which is a fluidized bed in which carbonaceous materials are combusted producing ash and combustion gases. The fluidized bed is supported on a perforated sloping support grid having a central opening in communication with a constricted central nozzle through which oxygen is injected into the fluidized bed forming a density/size selective solids withdrawal system. U.S. Pat. No. 4,229,289 discloses a fluidized bed process and apparatus having multiple perforated sloping support grids, each having a central opening in communication with a constricted central nozzle through which oxygen is injected forming multiple density/size solids withdrawal systems. Generally, the range of carbonaceous materials which can be processed in a fluidized bed reactor in a non-agglomerating mode is very broad. In the processes disclosed by the '758, '249 and '289 patents, however, the range of carbonaceous materials which can be processed in the agglomerating mode is limited to those materials which produce ash with ash-softening and melting temperatures near the bulk-bed temperature required by the particular carbonaceous material. This is due to the limited differential, on the order of a few hundred degrees Fahrenheit, between the hot zone temperature created in the fluidized bed by the injection of the oxygen-containing gas through the central opening in the bottom of the perforated sloping support grid and the bulk-bed temperature. U.S. Pat. No. 4,693,682 discloses a process for thermal treatment of solid particles within a fluidized bed having a selective heavier particle discharge conduit in communication with a sloping bed support and providing a discrete fluid fueled flame in close proximity to and above the opening to the heavier particle discharge conduit. The flame provides a single higher temperature zone in and around the flame having a temperature between about 100° F. to 400° F. above the temperature of the remainder of the fluidized bed. However, the higher temperature zone created by the flame does not provide the substantial temperature differential between the temperature of this higher temperature zone and bulk-bed temperature required to agglomerate ashes having high melting temperatures substantially above the temperature of the fluidized bed.

Processes which utilize fluidized beds and fluidized bed reactors are well known to those skilled in the art. U.S. Pat. No. 4,955,942 discloses a fluidized bed combustor having a bank of boiler tubes positioned within the bed. The bed material is supported on a flat preformated floor through which air is injected for fluidization of the bed. Fuel for heating the boiler tube bank is injected through burners positioned on the periphery of the combustor into the fluidized bed. U.S. Pat. No. 4,021,184 discloses a fluidized bed waste incinerator in which air is supplied to a wind box positioned below a flat constriction plate on which the bed is supported and having peripherally mounted fuel guns which penetrate the incinerator wall above the constriction plate for furnishing fuel to the incinerator chamber. U.S. Pat. No. 4,308,806 discloses a fluidized bed incinerator having a sloping bottom plate with a central opening and a burner for start-up of the incinerator positioned through the side wall of the incinerator above the sloping plate. U.S. Pat. No. 4,017,253 discloses a fluidized bed calciner in which heat is provided by a combustion nozzle contained within a tube or shroud which extends through the side wall of the calciner into the fluidized bed. Fuel and oxidant are mixed and combusted within the shroud and, due to the shroud, the fluidized bed particles are isolated from the high-velocity, high temperature portions of the resulting flame, thereby reducing particle attrition. U.S. Pat. No. 4,831,944 discloses a process and device for destroying solid waste by pyrolysis in which waste is introduced into the top of a reactor and flows downward counter to the flow of hot gas which is blown in at the base of the reactor through plasma jets positioned on the periphery of the reactor. A boiler having two fluidized beds, an upstream fluidized bed of sand in which fuel is combusted with air fed into the bed as fluidizing gas and a downstream fluidized bed of particulate limestone for desulfurizing the flue gases from the upstream bed, is disclosed by U.S. Pat. No. 4,815,418. A fluidized bed furnace having a distributor plate with fuel chambers and air tubes in communication with said fuel chambers which extend upward into a fluidized bed is disclosed by U.S. Pat. No. 3,914,089. U.S. Pat. No. 4,262,611 discloses a method and apparatus for waste incineration in which waste material is fed into a vessel having an upper pyrolysis chamber and a lower solids incineration chamber separated by a moveable gate. The waste material is subjected to volume reduction in the upper pyrolysis chamber after which it is discharged into the lower solids incineration chamber in which it is combusted. The resulting ash is collected in a frame at the bottom of the lower solids incineration chamber, which frame is removed periodically and the ash contained therein discarded. In the apparatus disclosed by U.S. Pat. No. 3,397,657, waste material is burned in a fluidized bed supported on a first distribution plate positioned above a first windbox and the non-flammable constituents thereof separated and discharged through a central discharge positioned below a second distribution plate, which plate, together with a second windbox above which it is positioned, is centrally positioned above the first distribution plate.

Of the prior art cited hereinabove, only the '758, '289, '682 and '249 patents disclose agglomeration in a fluidized bed system. In the processes disclosed by these patents, the range of carbonaceous materials which can be combusted therein is limited by the small differential, on the order of only a few hundred degrees, between the bulk-bed temperature and the hot zone temperatures within the bed in which the ash is softened and begins to agglomerate. To broaden the range of carbonaceous materials which can be combusted in an agglomerating mode, independent control of the bulk-bed temperature and hot zone temperature is required. None of the prior art of which we are aware discloses or suggests such independent control of bulk-bed temperature and hot zone temperature within a fluidized bed.

SUMMARY OF THE INVENTION

The composition and fusibility of ash from coal, for example, can vary widely, even within a particular coal seam. Ash composition and fusibility data for a large number of lignite, subbituminous and bituminous coals in the United States have been collected which show that for a large proportion of the coals, ash melting temperatures are above 2000° F., compared to known fluidized bed processes which generally operate below 2000° F. In addition, soils contaminated with metals and other hazardous inorganic compounds and treated in fluidized bed processes are composed primarily of $SiO_2$ and $Al_2O_3$, with fusion temperatures ranging from about 2000° F. to about 2550° F., depending on the amount and composition of other inorganics in the soil. Other waste streams suitable for processing in fluidized bed reactors include refuse derived fuels (RDF) and auto-shredder residue (ASR), both of which contain significant amounts of ash with softening and melting temperatures above 2200° F.

It is an object of this invention to provide a fluidized bed process in which ash having melting temperatures higher than the bulk-bed temperature of a fluidized bed, preferably between about 2000° F. and about 5000° F., is agglomerated and withdrawn from said fluidized bed.

It is another object of this invention to provide a fluidized bed process in which bulk-bed temperatures and temperatures within distinct regions within the fluidized bed are independently controlled.

It is yet another object of this invention to provide an ash agglomerating fluidized bed process in which a broad range of carbonaceous materials can be combusted, incinerated or gasified.

It is still a further object of this invention to provide an ash agglomerating fluidized bed process for waste incineration, combustion, or gasification in which bulk-bed temperature is controlled independent of temperatures in hot zones within the fluidized bed.

These objects are achieved in accordance with this invention in a fluidized bed process and apparatus in which carbonaceous material is introduced into a fluidized bed supported and maintained fluidized on a plate comprising one or more perforated sloping support grids. At the base of the perforated sloping support grid is an opening in communication with a nozzle through which a discharge control gas is injected into the fluidized bed. Positioned within the nozzle is a central jet pipe through which fuel and oxidant are injected into the fluidized bed, creating a hot temperature zone in the fluidized bed immediately above the nozzle and generally providing the heat for maintaining the bulk-bed temperature. Positioned above the perforated sloping support grid and inserted through the peripheral walls of the fluidized bed reactor are one or more burners through which additional fuel and oxidant are injected directly into the fluidized bed, creating separate hot temperature zones within the fluidized bed. The temperatures of these hot temperature zones, preferably between about 2000° F. and about 5000° F., are independently controlled by the amount of fuel and oxidant introduced through the central jet pipe and the burners into the individual hot temperature zones.

Ash generated within the fluidized bed in the hot temperature zones softens and becomes sticky causing the ash to agglomerate. Buoyed by the gas injected through the opening at the base of the perforated sloping support grid, the agglomerates are maintained within the bed until they reach a certain size and/or weight at which the velocity of the gas becomes insufficient to maintain them in the bed and they descend out of the fluidized bed and through the opening into a solids withdrawal conduit, at the bottom of which they are withdrawn. Because the temperature of the hot zones is substantially higher than the bulk-bed temperature, as high as 5000° F. versus 3000° F., higher melting temperature ashes can be agglomerated than in an agglomerating fluidized bed process which does not utilize this invention.

The process of this invention may be applied to fluidized bed waste incinerators, fluidized bed combustors, and fluidized bed gasifiers.

These and other objects and features of this invention will be more readily understood and appreciated from the description and drawings contained herein.

DESCRIPTION OF PREFERRED EMBODIMENTS

Figure 1:
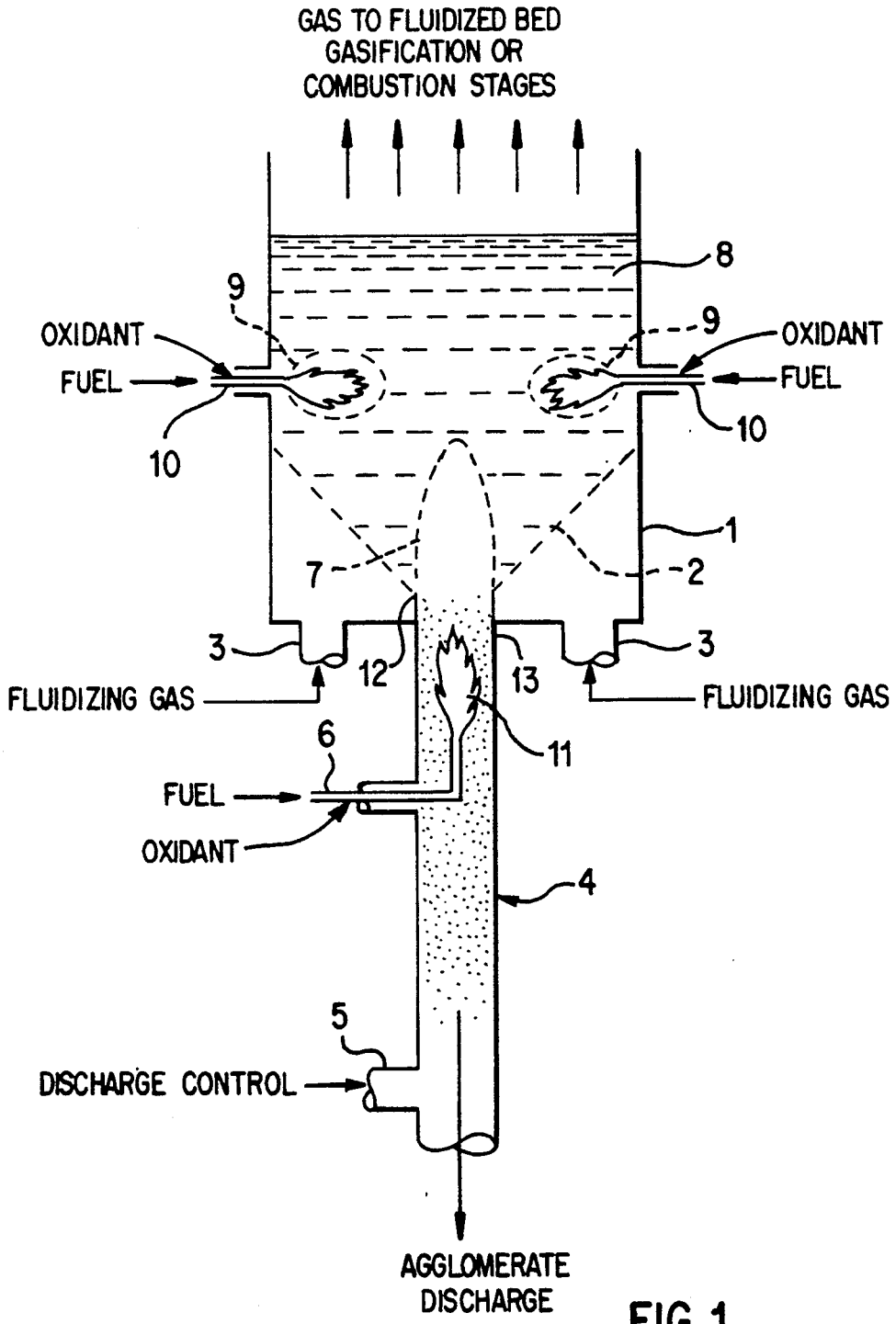
FIG. 1 is a schematic diagram of the invention utilized in a fluidized bed process.

Embodiments of the invention described herein are suitable for use in a variety of fluidized bed processes. A preferred embodiment of the invention which can be adapted for use in a variety of fluidized bed processes is shown in FIG. 1. In accordance with this invention, carbonaceous material is introduced into fluidized bed 8 which is retained in reactor vessel 1 and supported on perforated sloping support grid 2. A fluidizing gas is injected at inlet 3 positioned below perforated sloping support grid 2 and, passing through perforated sloping support grid 2, maintains fluidized bed 8 in a fluidized condition. The preferred superficial velocity within the fluidized bed is between about one to about fifteen feet per second. At the base of perforated sloping support grid 2 is sloping grid opening 12 which receives nozzle 13 of density/size selective solids withdrawal conduit 4. Injected into discharge control gas inlet 5 at the base of solids withdrawal conduit 4 and through nozzle 13 is discharge control gas, preferably air or mixtures of air and steam, the velocity of which determines the density/size of the solids which are withdrawn from the fluidized bed. Centrally positioned within solids withdrawal conduit 4 is central jet pipe 6 through which fuel and/or oxidant are injected through nozzle 13 into fluidized bed 8 creating hot temperature zone 7 at the bottom of fluidized bed 8. In accordance with another embodiment of this invention, the fuel and/or oxidant injected through nozzle 13 is used to maintain the bulk-bed temperature at the desired level, preferably in the range of about 600° F. to about 3000° F. rather than to maintain a given temperature within hot temperature zone 7. Discharge end 11 of central jet pipe 6 in one embodiment of the invention is positioned in nozzle 13 of solids withdrawal conduit 4 below sloping grid opening 12; in another embodiment of the invention shown in FIG. 4, it is positioned in sloping grid opening 12 even with the base of perforated sloping support grid 2. Positioning of discharge end 11 of central jet pipe 6 depends upon the particular application of the invention. In fluidized bed gasifiers, it is preferably positioned in sloping grid opening 12 even with the base of perforated sloping support grid 2. In fluidized bed combustors and incinerators, it is positioned below sloping grid opening 12.

It will be apparent to those skilled in the art, as exemplified by U.S. Pat. No. 4,693,682, that with only a single input for fuel and/or oxidant, as through nozzle 13, the differential between the temperature of hot temperature zone 7 and the bulk-bed temperature of fluidized bed 8 is necessarily limited. To overcome this limitation, in preferred embodiments of this invention, oxidant or mixtures of fuel and oxidant at substoichiometric, stoichiometric or excess oxidant to fuel ratios, depending on the particular embodiment of the invention, are injected through peripheral nozzles 10 directly into fluidized bed 8 creating supplemental hot temperature zones 9 which may reach temperatures as high as 5000° F. in fluidized bed 8. The temperature of supplemental hot temperature zones 9 is controlled separate and apart from the bulk-bed temperature by the amount of oxidant or fuel and oxidant injected into fluidized bed 8 through peripheral nozzles 10. Ash generated in fluidized bed 8 melts and becomes sticky in supplemental hot temperature zones 9 and hot temperature zone 7 and, as the sticky ash particles collide, they agglomerate and/or vitrify. To facilitate agglomeration or vitrification of ash, soils, or other solid materials in fluidized bed 8, a flux material may be introduced into reactor vessel 1 to reduce the fusion temperature required for agglomeration or vitrification. As the agglomerates and/or vitrified solids increase in size and/or weight, they gravitate toward the base of perforated sloping support grid 2 where, upon reaching the size and/or weight at which the velocity of the discharge control gas is no longer able to maintain them in the bed, they descend through sloping grid opening 12 into solids withdrawal conduit 4 in which they undergo additional agglomeration before being withdrawn.

Figure 2:
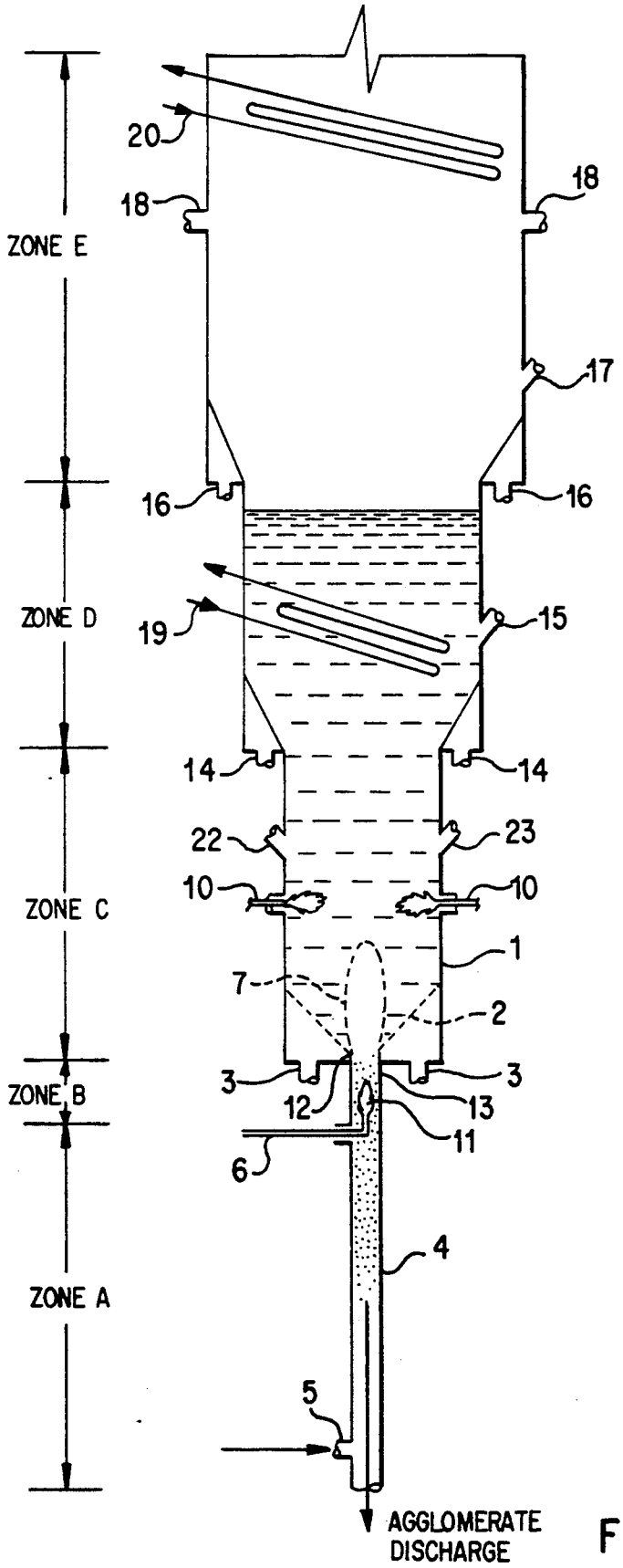
FIG. 2 is a schematic diagram of an embodiment of the invention in a fluidized bed combustor.

FIG. 2 depicts an embodiment of the invention in a fluidized bed combustion process, which process is defined by five zones, A–E. Zone A comprises that portion of solids withdrawal conduit 4 in which ash agglomerate discharge size classification occurs. Zone B comprises that portion of solids withdrawal conduit 4 in which second stage agglomeration and/or oxidation of the agglomerates occurs. Zone C comprises that portion of the process in which fluidized bed combustion and first stage agglomeration occurs. Zone D comprises that portion of the process in which the reduction of $NO_x$ and/or capture of sulfur in the combustion gases in the fluidized bed occurs. Zone E comprises that portion of the process above the fluidized bed in which the reduction of $NO_x$ and/or capture of sulfur in the combustion gases occurs.

In this embodiment of the invention, air, the preferred discharge control gas, is injected through discharge control gas inlet 5 into of solids withdrawal conduit 4. Air, which is also the preferred fluidizing gas, is also injected through inlet 3. A high heating value fuel, preferably natural gas, and air, oxygen or a mixture thereof, are injected through central jet pipe 6 into nozzle 13 in which the fuel is combusted forming a second stage agglomeration region at discharge end 11. The combustion products are then injected through sloping grid opening 12 into fluidized bed 8. Discharge end 11 of central jet pipe 6 in this embodiment of the invention is positioned below the point at which sloping grid opening 12 receives nozzle 13. In this embodiment, combustion of the fuel at discharge end 11 provides heat for second stage agglomeration and oxidation of the agglomerates from the first stage agglomeration in fluidized bed 8 as they descend from fluidized bed 8 into solids withdrawal conduit 4. In addition, heat input for maintenance of the bulk-bed temperature of fluidized bed 8 and temperature of hot temperature zone 7 is provided.

Carbonaceous materials to be combusted in the fluidized bed, preferably solids feed fossil fuels and/or biomass, are injected into reactor vessel 1 through feed inlet 22. Operation of the process of this embodiment of the invention under oxidizing conditions within the lower portion of the fluidized bed is preferred. Although shown as being injected directly into fluidized bed 8, the carbonaceous materials may also be injected into reactor vessel 1 into the primary zone above fluidized bed 8. Oxidant or mixtures of fuel and oxidant are injected into fluidized bed 8 through peripheral nozzles 10 creating supplemental hot temperature zones 9. Liquid or gaseous fuels mixed with air or oxygen are preferred.

To reduce $NO_x$ emissions from the combustor, fuel gas and/or recirculated flue gas (RFG) are injected into the upper portion of fluidized bed 8 through primary RFG inlets 14 forming a reburn zone in fluidized bed 8 in which reducing conditions are maintained. To control sulfur emissions from the combustion of sulfur containing carbonaceous materials, a sorbent, preferably granular limestone or dolomite, is injected into the upper portion of fluidized bed 8 through primary sorbent inlet 15 and/or into the primary zone above fluidized bed 8 through secondary sorbent inlet 17. Addition of a sorbent also provides improved control of the agglomeration of ash, sorbent reaction products and unreacted sorbents as well as improved conversion of calcium sulfide to calcium sulfate in the ash discharge stream.

To reduce combustible emissions in the flue gas in this embodiment of the invention, overfire air and/or oxygen (OFA) is injected into reactor vessel 1 through OFA inlets 16 and/or 18. In addition, to control $NO_x$ emissions in the flue gases, fuel gas and/or RFG are injected into reactor vessel 1 through OFA inlets 16. Gases from reactor vessel 1 are conveyed to a cyclonic second stage (not shown) and/or a gas treatment system (also not shown). Fine particulate matter which is carried over to the cyclonic second stage and/or the gas treatment system is recycled to fluidized bed 8 through fines inlet 23. Heat from the process of this embodiment of the invention is withdrawn as steam through heat exchanger 19 and as superheat through super heat exchanger 20.

Figure 3:
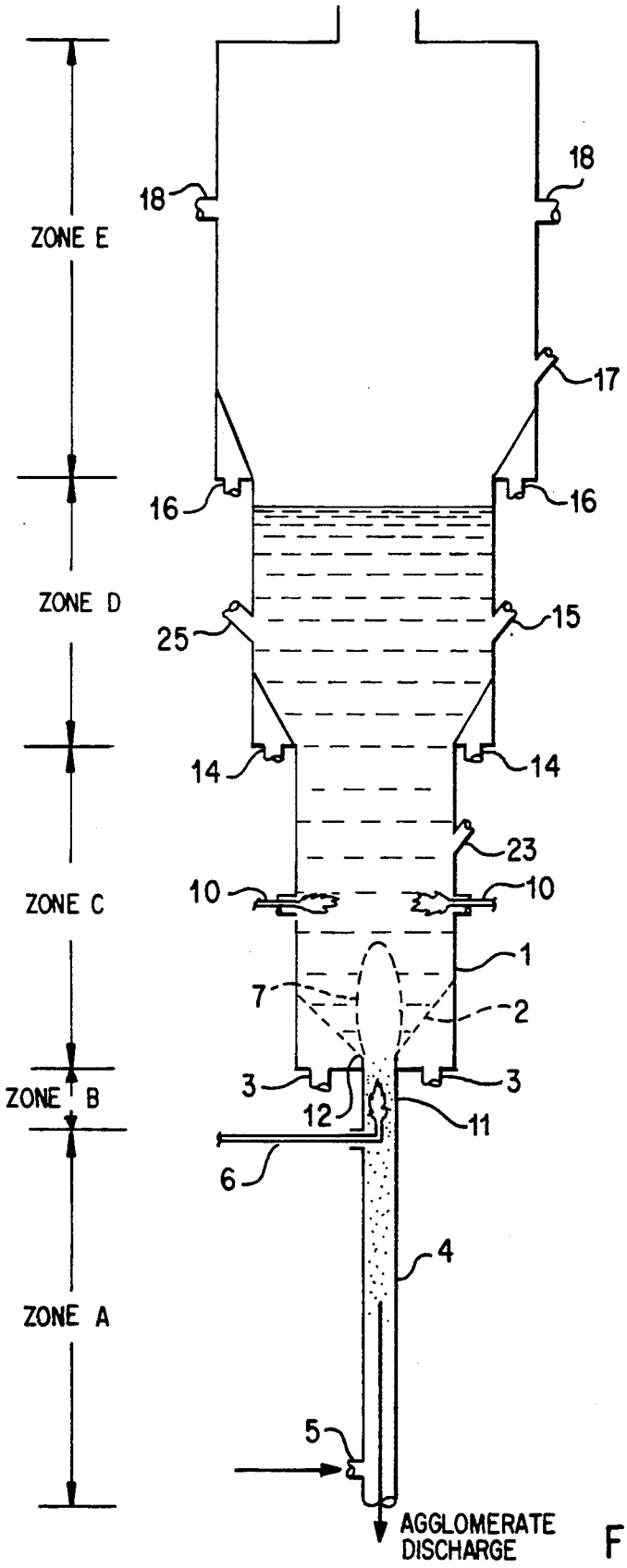
FIG. 3 is a schematic diagram of an embodiment of the invention in a fluidized bed incinerator.

In FIG. 3, an embodiment of the invention as a fluidized bed incinerator is shown. Unlike the embodiment depicted in FIG. 2, Zone C comprises that portion of the fluidized bed incineration process in which carbonaceous waste materials are incinerated and agglomeration occurs. Zones A, B, D and E function essentially the same as described above for the embodiment of the invention as a fluidized bed combustor shown in FIG. 2. Carbonaceous waste material comprising solids containing organic compound contaminants, including contaminated soils, and other low-heating-value waste materials, is injected into fluidized bed 8 which is operated under oxidizing conditions, through waste inlet 25. Air, the preferred discharge control gas, is injected through discharge control gas inlet 5; air is also the preferred fluidizing gas and is introduced into fluidized bed 8 through inlet 3. Fuel and oxidant are injected through peripheral nozzles 10 into fluidized bed 8 forming supplemental hot temperature zones 9 and through central jet pipe 6 forming hot temperature zone 7 in fluidized bed 8 and a second stage agglomeration and oxidation region in solids withdrawal conduit 4. Bulk-bed temperature of fluidized bed 8 in this embodiment is between about 600° to 1200° F. for volatilization and removal of organic and other volatile components. In addition to agglomeration of ash generated in fluidized bed 8, the solid components of the waste materials are also agglomerated or vitrified, encapsulating therein any metal or other inorganic contaminants present in the waste material, and then discharged from fluidized bed 8 through solids withdrawal conduit 4. In this manner, the discharged solids are rendered non-leachable.

Figure 4:
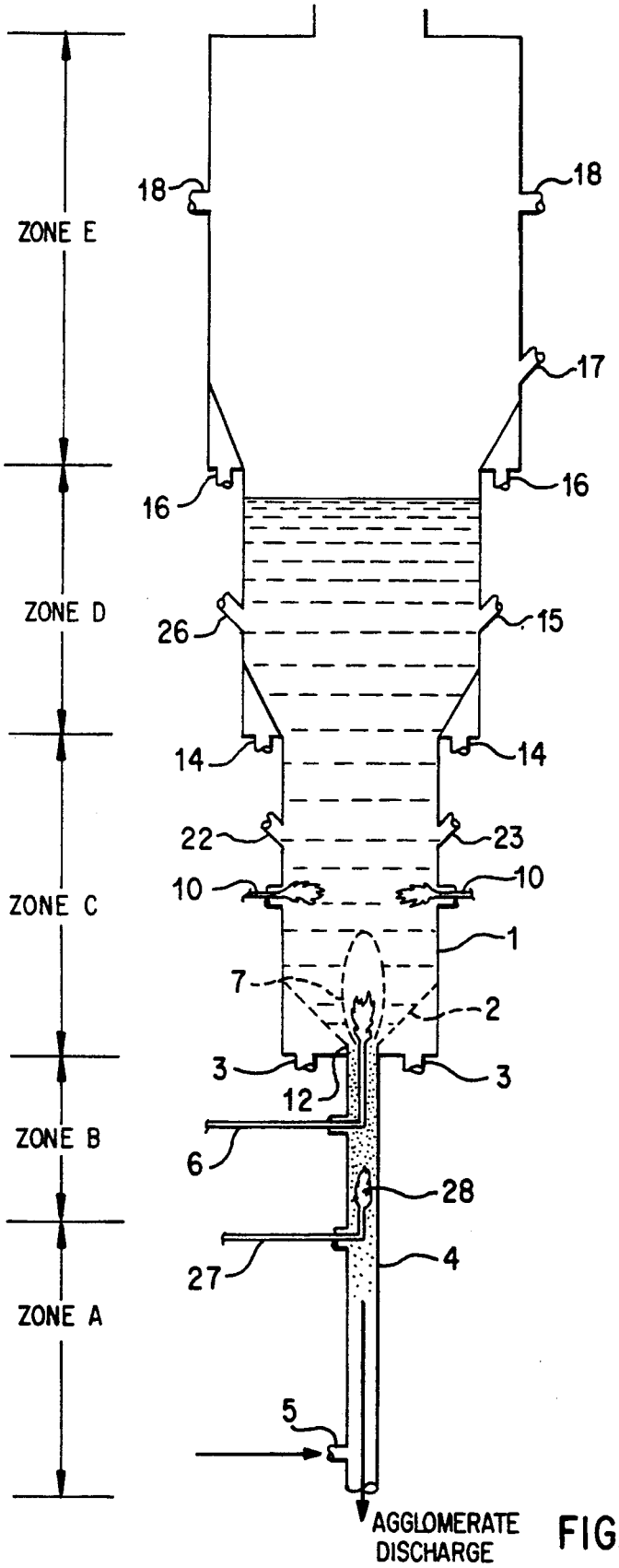
FIG. 4 is a schematic diagram of an embodiment of the invention in a fluidized bed gasifier.

In an embodiment of the invention as a fluidized bed gasifier shown in FIG. 4, where Zone C comprises that portion of the process in which carbonaceous materials are gasified and agglomeration occurs, steam and/or air, the preferred discharge control gas, is injected through discharge control gas inlet 5 into solids withdrawal conduit 4. Carbonaceous material to be gasified is injected into fluidized bed 8 through gasifier material inlet 22 and/or 26. Fluidized bed 8 is operated in this embodiment of the invention under reducing conditions. Air, oxygen, steam and mixtures thereof are preferred as fluidizing gases and are injected below perforated sloping support grid 2 through inlet 3. In this embodiment of the invention, discharge end 11 of central jet pipe 6 is positioned at/or above sloping grid opening 12. Air, oxygen, steam and mixtures thereof are preferably injected through central jet pipe 6 into fluidized bed 8 at oxygen concentrations between about 75% to about 100% of the total amount of fluids injected through central jet pipe 6 and forming hot temperature zone 7. Oxidant or mixtures of fuel and oxidant are injected through peripheral nozzles 10 forming supplemental hot temperature zones 9. Positioned below central jet pipe 6 in solids withdrawal conduit 4 is second stage agglomeration fuel inlet 27 through which is injected fuel and oxidant which is combusted in solids withdrawal conduit 4 forming a second stage agglomeration and oxidation region 28 in which agglomerated particles descending through solids withdrawal conduit 4 are further agglomerated and oxidized.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a process for thermal agglomeration of high melting temperature ashes wherein a carbonaceous material is introduced into a fluidized bed supported upon and maintained fluidized by fluidizing gas introduced through a perforated sloping bed support grid having a density/size selective solids withdrawal conduit at a base portion of said bed with upflowing discharge control gas, the improvement comprising:

introducing one of a fuel mixture and an oxygen mixture into said fluidized bed, said fuel mixture comprising a fuel and one of air and oxygen and said oxygen mixture selected from the group consisting of oxygen, steam and oxygen, and nitrogen and oxygen and having oxygen concentrations between about 75% to 100%, each said fuel mixture and said oxygen mixture being introduced through an inlet positioned above said perforated sloping bed support grid producing a hot zone within said fluidized bed having a hot zone temperature of about 2000° F. to about 5000° F. and at least one of said withdrawal conduit and a central jet pipe positioned in said withdrawal conduit; and maintaining a bulk-bed temperature in said fluidized bed of about 600° F. to about 3000° F.

2. A process in accordance with claim 1, wherein said fuel mixture introduced through said inlet positioned above said perforated sloping bed support grid forms a discrete flame within said fluidized bed.

3. A process in accordance with claim 1, wherein said bulk-bed temperature is one of equal to and less than said hot zone temperature.

4. A process in accordance with claim 1, wherein said bulk-bed temperature is controlled by one of said fuel mixture and said oxygen mixture being introduced through said central jet pipe and said hot zone temperature is controlled by one of said fuel mixture and said oxygen mixture being introduced through said inlet positioned above said sloping fluidized bed support grid.

5. A process in accordance with claim 1, wherein a second hot zone having a second hot zone temperature of about 2000° F. to about 5000° F. is produced in said base portion of said fluidized bed by one of said fuel mixture and said oxygen mixture being introduced through said central jet pipe.

6. A process in accordance with claim 1, wherein a sorbent selected from the group consisting of limestone, dolomite, calcium oxide, calcium hydroxide and mixtures thereof is introduced into one of said fluidized bed and a primary zone above said fluidized bed.

7. A process in accordance with claim 1, wherein said carbonaceous material is gasified in said fluidized bed under substoichiometric oxygen conditions producing ash and reducing gases forming a reducing zone in said fluidized bed, said reducing gases comprising gaseous sulfur compounds.

8. A process in accordance with claim 7, wherein said ash is agglomerated in said fluidized bed, selectively separated from said fluidized bed and withdrawn through said withdrawal conduit.

9. A process in accordance with claim 1, wherein said carbonaceous material is combusted in said fluidized under one of stoichiometric oxygen and excess oxidant-to-fuel conditions producing ash and oxidizing gases forming an oxidizing zone within said fluidized bed, said oxidizing gases comprising gaseous sulfur compounds.

10. A process in accordance with claim 9, wherein said ash is agglomerated in said fluidized bed, selectively separated from said fluidized bed and withdrawn through said withdrawal conduit.

11. A process in accordance with claim 1, wherein overfire oxidant is injected into a primary zone above said fluidized bed.

12. A process in accordance with claim 1, wherein at least one of a fuel gas and recycled flue gases is injected into said fluidized bed producing a reducing reburn zone within an upper portion of said fluidized bed.

13. A process in accordance with claim 1, wherein at least one of a fuel gas and recycled flue gases is injected into a primary zone above said fluidized bed.

* * * * *